US007444946B2

(12) United States Patent
Rodney et al.

(10) Patent No.: US 7,444,946 B2
(45) Date of Patent: Nov. 4, 2008

(54) MATERIAL MANAGEMENT APPARATUS, SYSTEMS, AND METHODS

(75) Inventors: Paul F. Rodney, Spring, TX (US); Jon Troy Gosney, Bellville, TX (US); James Dudley, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 409 days.

(21) Appl. No.: 10/940,311

(22) Filed: Sep. 14, 2004

(65) Prior Publication Data

US 2006/0054013 A1 Mar. 16, 2006

(51) Int. Cl.
*E05G 1/10* (2006.01)

(52) U.S. Cl. ..... 109/63.5; 89/36.07

(58) Field of Classification Search ..... 89/36.07, 89/36.17; 109/36, 37, 49.5, 63.5; 340/539.22, 340/539.27, 539.29
See application file for complete search history.

(56) References Cited

U.S. PATENT DOCUMENTS

| | | | | | |
|---|---|---|---|---|---|
| 2,840,405 | A * | 6/1958 | Feltz et al. | 292/122 |
| 4,100,860 | A * | 7/1978 | Gablin et al. | 109/83 |
| 4,236,463 | A * | 12/1980 | Westcott | 109/33 |
| 4,721,227 | A * | 1/1988 | Hughes et al. | 220/560.01 |
| 4,893,397 | A * | 1/1990 | Hughes | 29/428 |
| 5,519,609 | A | 5/1996 | Kuchenrither et al. | 702/5 |
| 5,648,763 | A | 7/1997 | Long | 340/825.49 |
| RE35,920 | E | 10/1998 | Sorden et al. | 342/457 |
| 5,960,413 | A | 9/1999 | Amon et al. | 705/28 |
| 6,088,648 | A | 7/2000 | Shah et al. | 701/117 |
| 6,133,842 | A * | 10/2000 | Gariepy | 340/689 |
| 6,188,353 | B1 | 2/2001 | Mitchell | 342/386 |
| 6,313,791 | B1 | 11/2001 | Klanke | 342/357.17 |
| 6,484,660 | B1 | 11/2002 | English | 114/312 |
| 6,505,101 | B1 | 1/2003 | Brill | 701/2 |
| 6,512,466 | B2 | 1/2003 | Flick | 340/989 |
| 6,552,648 | B1 | 4/2003 | Rick et al. | 340/5.1 |
| 6,556,138 | B1 | 4/2003 | Sliva et al. | 340/568.1 |
| 6,628,201 | B2 | 9/2003 | Cho et al. | 340/600 |
| 6,678,612 | B1 | 1/2004 | Khawam | 701/213 |
| 6,693,563 | B2 | 2/2004 | Flick | 340/989 |
| 6,701,231 | B1 | 3/2004 | Borugian | 701/30 |
| 6,705,522 | B2 | 3/2004 | Gershman et al. | 235/385 |
| 7,038,585 | B2 * | 5/2006 | Hall et al. | 340/539.22 |

(Continued)

FOREIGN PATENT DOCUMENTS

EP 1355505 A1 10/2003

(Continued)

OTHER PUBLICATIONS

English abstract of JP 360012201 A.*

*Primary Examiner*—Stephen M Johnson
(74) *Attorney, Agent, or Firm*—Schwegman, Lundberg & Woessner, P.A.

(57) ABSTRACT

In some embodiments, an apparatus that can be used to contain radiation sources, explosives, and other material transported as cargo may include layers of lead, tungsten, plastic, paraffin, armor, and heat absorbing material to surround an interior portion, as well as a lockable port to provide access to the interior portion. In some embodiments, activities may include detecting various conditions associated with the layers or cargo, and impeding access to the interior portion responsive to detecting the conditions.

56 Claims, 3 Drawing Sheets

U.S. PATENT DOCUMENTS

| | | | | |
|---|---|---|---|---|
| 2002/0052687 | A1 | 5/2002 | Doyle | 701/207 |
| 2002/0138197 | A1 | 9/2002 | Schramke et al. | 701/231 |
| 2002/0156577 | A1 | 10/2002 | Flick | 340/989 |
| 2003/0011466 | A1 | 1/2003 | Samuel et al. | 340/5.73 |
| 2003/0083815 | A1 | 5/2003 | Denton | 701/213 |
| 2003/0139909 | A1 | 7/2003 | Ozawa | 702/183 |
| 2003/0149526 | A1 | 8/2003 | Zhou et al. | 701/213 |
| 2003/0156010 | A1 | 8/2003 | Roeland | 340/5.73 |
| 2003/0193433 | A1 | 10/2003 | Carson | 342/357.07 |
| 2003/0230124 | A1 * | 12/2003 | Johnson et al. | 70/267 |
| 2004/0006424 | A1 | 1/2004 | Joyce et al. | 701/207 |
| 2004/0012518 | A1 | 1/2004 | Mohan | 342/357.1 |
| 2004/0015336 | A1 | 1/2004 | Kulesz et al. | 703/11 |
| 2004/0041705 | A1 | 3/2004 | Auerbach et al. | 340/539.22 |

FOREIGN PATENT DOCUMENTS

| | | | | |
|---|---|---|---|---|
| JP | 360012201 | A | * | 1/1985 |
| WO | WO-03056490 | A1 | | 7/2003 |
| WO | WO-03085926 | A1 | | 10/2003 |

* cited by examiner

MATERIAL MANAGEMENT APPARATUS, SYSTEMS, AND METHODS

TECHNICAL FIELD

Various embodiments described herein relate to managing material, including locating, tracking, and regulating access to such material transported as cargo.

BACKGROUND INFORMATION

Radiation sources and explosives can be used in various ways to support many different types of industrial operations, including those conducted in the oil field industry. During transport, these sources and explosives may be misplaced or stolen. This problem also presents itself during the transport of other material. Thus, there is a need to enhance the ability to manage such material, including the provision of apparatus, systems, and methods used to monitor and track material (e.g., sources, explosives) during transport, as well as to control access to and use of the material.

DETAILED DESCRIPTION

The challenges described above may be addressed by providing a container, including an armored container, for various types of material, including radiation sources and explosives that are transported from one location to another. In some embodiments, the container may include singly, or in combination, layers of lead, tungsten, plastic, and paraffin. The container may be augmented by radio-frequency identification and geolocation devices attached to the layer(s), as well as a lockable port to provide access to the interior portion. Such containers may be used to hold and transport various types of material as cargo, including explosives and radioactive sources, depending on the combination of layers used to construct the container. In some embodiments, the container may include two or more layers of armor, as well as one or more insulating layers disposed between them. Various features, including geolocation tracking, tamper-resistant switches, environmental sensors, alarming capability, and other elements may be added to the container to monitor the cargo location, and to render unauthorized access to the cargo exceedingly difficult.

Figure 1:
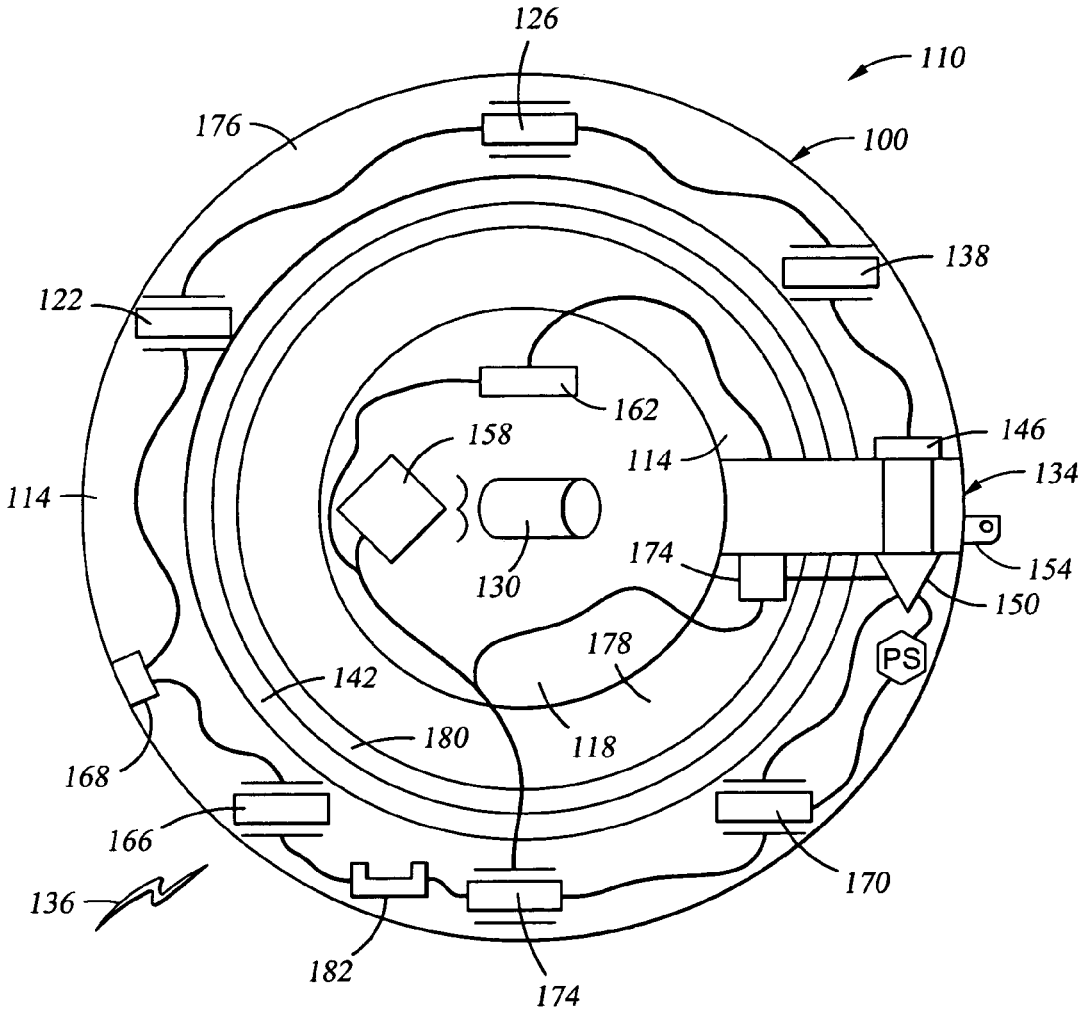
FIG. 1 is a block diagram of apparatus and systems according to various embodiments of the invention.

FIG. 1 is a block diagram of apparatus 100 and systems 110 according to various embodiments of the invention, each of which may operate in the manner previously described. For example, an apparatus 100, such as a container, may comprise one or more layers 114, including a material selected from lead, tungsten, plastic, paraffin, steel, vanadium, and composite materials fabricated from nanoparticles, either singly or in combination, to substantially surround an interior portion 118 of the container. For more information regarding such nanoparticles, including single-wall carbon nanotubes with nanometer-scale coatings of another material that can include polymers and metals, see the announcement by Carbon Nanotechnologies, Inc. at http://www-cnanotech-com/pages/resources_and_news/press_release_archive/press_story_enabling_IP-html (to avoid inadvertent hyperlinks, the periods in the referenced URL have been replaced by dashes), as well as the content of U.S. Pat. Nos. 6,756,026; 6,756,025; 6,752,977; 6,749,827; 6,692,717; 6,683,783; 6,645,455; 6,183,714; 5,591,312; 5,556,517; 5,300,203; 5,227,038 incorporated herein by reference in their entirety. The apparatus 100 may comprise a radiation source transport pig, a well logging radioactive source pig, a drum, or any other container that can be used to transport material, including explosives and radiation sources, such as radioactive waste.

In some embodiments, the apparatus 100 may include one or more radio-frequency identification devices (RFIDs) 122, and one or more geolocation devices 126 (e.g., global positioning system (GPS) receivers; transmitters, receivers, transceivers using triangulation; etc.) attached to at least one of the layers 114. Various types of cargo 130, such as explosive devices (e.g., perforating caps), radioactive sources (e.g., Cesium-137, Americium-Beryllium, and Californium), and other material may be transported using the apparatus 100. Thus, the geolocation device 126 may be capable of providing location coordinates (absolute or relative) associated with the interior portion 118 and/or the cargo 130.

In some embodiments, various mechanisms may be employed to control access to the cargo 130. For example, the apparatus 100 may also include a lockable port 134 to provide access to the interior portion 118 via the layer 114.

Various types of sensors 138 may be used in conjunction with the apparatus 100. For example, the apparatus 100 may include one or more of a vibration sensor to indicate a level of vibration experienced by the layer 114, a temperature sensor to indicate a temperature experienced by the layer 114, and/or a shock sensor to indicate a level of shock experienced by the layer 114, among others. Strain sensors, among others, may be used to measure the level of shock.

The apparatus 100 may also include a heat-activated, human-toxic material 142 substantially surrounded by the layer 114. An example of such a material 142 is one that comprises a phenolic compound (e.g., phenolic plastic that emits phosgene gas when heated).

The apparatus 100 may also include one or more tamper-resistant switches 146, perhaps connected so as to respond to an open condition of the lockable port 134. Thus, for example, if the tamper-resistant switch 146 enters a closed condition upon the lockable port 134 being opened, a signal 136, such as an alarm signal, might be generated in response.

In some embodiments, the apparatus 100 may comprise a lock 150 included in the lockable port 134, perhaps responsive to an indication of a condition associated with the layer(s) 114 exceeding a selected level. For example, if a sensor 138 provided an indication that a level of vibration observed at the surface of the layer 114 exceeded a given level, or a level of shock on the layer 114 exceeded a preselected amount, or if a temperature on the surface of the layer 114 exceeded a permitted level, then the lock 150 might activate. It should be noted that the lock 150 may be embedded in the apparatus 100, so as not to be directly accessible from the exterior of the apparatus 100. In some embodiments, the lock 150 may be designed such that an external power supply (not shown) is required to open/close (e.g., by deactivating/activating the lock 150). Thus, after the external supply is coupled to the lock 150, the lock 150 may be activated. Additional and more conventional locks 154, perhaps accessible from the exterior of the apparatus 100, may be included in the lockable port 134.

In some embodiments, the apparatus 100 may include a cargo-immobilizing mechanism 158. This mechanism 158 may also be responsive to an indication associated with a condition of the layer(s) 114 exceeding a selected level. Thus, for example, if a sensor 138 provided an indication of an exceptionally-high temperature at the surface of the layer 114, or large levels of shock, or vibrations above a selected level for more than a selected amount of time, the cargo-immobilizing mechanism 158 might release an expanding foam, polymer, and/or epoxy solution to substantially surround the cargo 130. Such activity may operate to render the cargo 130 substantially immobile, as well as very difficult to extract from the interior portion 118.

Other features may be included in the apparatus 100. In some embodiments, the apparatus 100 may include a radiation detection device 162 coupled to the lockable port 134 (either directly, or perhaps indirectly, via a controller—see element 182 below). Thus, if the cargo 130 comprises a radioactive source, and the radiation detection device 162 indicates that no source is present, then a signal 136, such as an alarm signal, might be generated. Sources of radiation carried as cargo 130 and detected by the radiation detection device 162 may be selected from a number of possibilities, in addition to the examples given above, including one or more of natural (e.g., chemical) gamma ray emitters, natural x-ray emitters, natural neutron emitters, natural alpha particle emitters, natural electron emitters, natural position emitters, and natural proton emitters. In some embodiments, the radiation source transported as cargo 130 may be capable of providing radiation at a rate of greater than about $2 \cdot 10^8$ particles per second through a surface surrounding the source, such as a substantially spherical surface, including the layers 114.

The apparatus 100 may include various elements to assist in communicating with local and/or remote control stations (see discussion respecting FIG. 2, below). For example, the apparatus 100 may include one or more communications transceivers 166 coupled to the lockable port 134 and/or the geolocation device 126 (either directly, or perhaps indirectly, via a controller—see element 182 below). Receipt by the transceiver 166 of a signal 136 to activate the lock 150 is then possible. Further, the transceiver 166 may operate to transmit the location of the apparatus 100, including the cargo 130, as provided by the geolocation device 126. Additional or alternative mechanisms for communication may include a communications interface 168 coupled to the lockable port (either directly, or perhaps indirectly, via a controller—see element 182 below). Such interfaces 168 may include wired interfaces (e.g., a Universal Serial Bus (USB) interface), and wireless interfaces (e.g., Institute of Electrical and Electronics Engineers 802.11 interface, Bluetooth, etc.).

For more information regarding the USB interface, see the related standards: Universal Serial Bus 1.0 and later versions at www-usb-org (to avoid inadvertent hyperlinks, the periods in the previous URL have been replaced by dashes). For more information regarding the mentioned wireless interfaces, please refer to For more information regarding some of the formatting mechanisms mentioned above, please refer to "IEEE Standards for Information Technology—Telecommunications and Information Exchange between Systems—Local and Metropolitan Area Network—Specific Requirements—Part 11: Wireless LAN Medium Access Control (MAC) and Physical Layer (PHY), ISO/IEC 8802-11: 1999" and "Bluetooth System Specification, Bluetooth Special Interest Group, Ver. 1.1, March 2001", and related amendments.

Other features may be incorporated to control access to the cargo 130. For example, the apparatus 100 may include a power-interrupting device 170 (e.g., a resettable circuit breaker, a one-time, current-sensitive fuse, etc.) coupled to the power supply PS of an electric lock 150 included in the lockable port 134. Thus, in some embodiments, the transceiver 166 may receive a signal 136 to command the lock 150 to lock the lockable port 134, and then to leave the lock 150 in a locked state by disabling power supplied to the lock 150 via the power supply PS (e.g., by activating the power-interrupting device 170). In some embodiments, the power-interrupting device 170 may be operated so as to re-enable the supply of power from the power supply PS to the lock 150, perhaps upon receiving an assurance code (e.g., in the signal 136) from a local control station, or a remote control station. As noted previously, the power supply PS may be located external to the apparatus 100.

More elaborate scenarios may be envisioned. For example, the apparatus 100 may include a multiple-stage permission mechanism 174, such as a two-stage permission mechanism, coupled to a lock 150 included in the lockable port 134 (either directly, or perhaps indirectly, via a controller—see element 182 below). For the purposes of this document, a "two-stage permission mechanism" means a mechanism that may be activated or deactivated by a combination of two entities. For example, a local control station may provide a first permission code, and a remote control station may provide a second permission code. The combination of two permission codes received within a selected time interval may operate to either activate or deactivate the two-stage permission mechanism, depending on the desires of the designer of the apparatus 100. More stages, and thus, higher levels of permission, may be added.

The permission mechanism 174 may be used in a number of ways. For example, a two-stage permission mechanism may operate to activate the power-interrupting device 170 coupled to the electric lock 150 upon correctly receiving two codes. This may occur, for example, responsive to receiving, in addition to another code, a hostile code (e.g., in a signal 136) from a local control station or a remote control station. A "hostile code" means any code that is selected to indicate a situation where the cargo 130 may be in danger of loss or theft. As noted above, the power-interrupting device 170 may also operate to enable the supply of power to the lock 150. Thus, the permission mechanism may be used to deactivate the power-interrupting device coupled to an electric lock in the lockable port responsive to receiving a permission code from a remote control station. Other embodiments may be realized.

For example, the apparatus 100 may include multiple layers of armor 176, 178, such as a first layer of armor 176 and a second layer of armor 178. The apparatus 100 may also include one or more heat absorbing layers 180 substantially surrounded by the first layer of armor 176, and substantially surrounding the second layer of armor 178. The layers of armor 176, 178 may comprise singly, or in combination, metals, ceramics, aramid fibers, shear-thickening fluid, and polyethylenes. In this case, the lockable port 134 may be used to provide access to the interior portion 118 via the first and second layers of armor 176, 178. The heat absorbing layer 180 may comprise silica (e.g., various types of aerogels available from Aspen Aerogels, Inc. of Northborough, Mass.), fiberglass, fluids, etc. Many other embodiments may be realized.

For example, in some embodiments, a system 110 may comprise one or more apparatus, similar to or identical to the apparatus 100, as well as one or more sensors 138 to sense an indication of a condition of the layers 114, including the layers of armor 176, 178. In some embodiments, the system 110 may include a controller 182 coupled to the sensor(s) 138. As noted above, the sensor(s) 138 may be selected from one or more of a vibration sensor, a temperature sensor, and a shock sensor, among others. In addition, the system 110 may include a heat-activated, human-toxic material (e.g., a phenolic compound) substantially surrounded by the layer 114, including the first layer of armor 176, for example. The controller 182 may comprise a logic integrated circuit, a microprocessor, a computer, and a portable computing device, among others.

The addition of a controller 182 can add a great deal of flexibility to various embodiments of the system 110. For example, the controller 182 may be used to operate a lock 150 included in the lockable port 134, perhaps responsive to the indication of a condition associated with one or more of the layers 114 exceeding a selected level, as sensed by one or more of the sensors 138. The controller 182 may also be coupled to many other elements in the system 110, such as the communications interface 168, the geolocation device 126, the radiation detection device 162, the communications transceiver 166, the tamper-resistant switch 146, and/or the power-interrupting device 170. The controller 182 may also be used to activate the cargo-immobilizing mechanism 158 described above, perhaps responsive to an indication of a sensed condition of one or more of the layers 114 exceeding a selected level. Many other embodiments may be realized.

Figure 2:
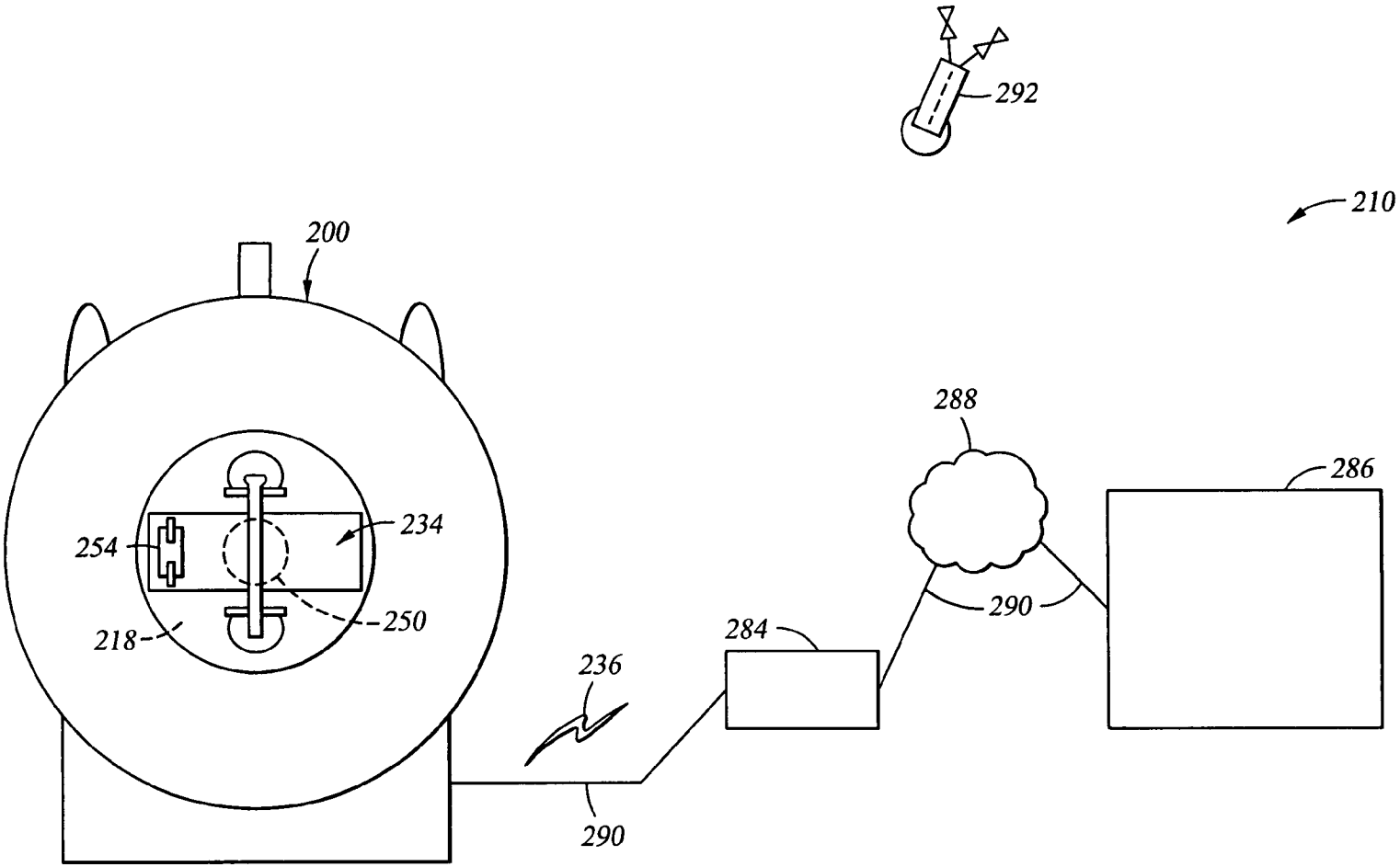
FIG. 2 is a block diagram of additional example embodiments of the invention.

For example, FIG. 2 is a block diagram of additional example embodiments of the invention. As shown, an apparatus 200 and system 210 may be similar to or identical to the apparatus 100 and system 210 described above and shown in FIG. 1. Thus the apparatus 200 and system 210 may include a lockable port 234, an internal lock 250, and one or more external locks 254.

In some embodiments, the system 210 may include a local control station 284 and/or a remote control station 286. Communications with the apparatus 200 may be accomplished via wireless signals 236, a local or global network 288, such as the Internet, and/or via wires 290. Satellites 292 and other mechanisms may also be used to effect communication between the local control station 284, the remote control station 286, and the apparatus 200.

In some embodiments, the local control station 284, and/or the remote control station may send a query code to the controller (see controller 182 in FIG. 1) coupled to receive an indication of the condition of one or more layers (e.g., layers 114 shown in FIG. 1) for the purpose of ascertaining the condition of the apparatus 200. The query code may be sent on a periodic basis, such as every five minutes. If no response (e.g., an assurance code) is received from the apparatus 200, a power-interrupting device (see device 170 in FIG. 1) coupled to the lock 250 providing access to the interior portion 218 may be activated, so as to lock the lockable port 234, and to disable access to the interior portion 218.

The apparatus 100, 200; systems 110, 210; layers 114; interior portion 118; RFIDs 122; geolocation devices 126; cargo 130; lockable ports 134, 234; sensors 138; human-toxic material 142; tamper-resistant switches 146; locks 150, 154, 250, 254; cargo-immobilizing mechanism 158; radiation detection device 162; communications transceivers 166; communications interface 168; power-interrupting device 170; multiple-stage permission mechanism 174; layers of armor 176, 178; heat absorbing layers 180; controller 182; local control station 284; remote control station 286; network 288; wires 290; and satellites 292 may all be characterized as "modules" herein. Such modules may include hardware circuitry, and/or a processor and/or memory circuits, software program modules and objects, and/or firmware, and combinations thereof, as desired by the architect of the apparatus 100, 200 and systems 110, 210, and as appropriate for particular implementations of various embodiments. For example, in some embodiments, such modules may be included in an apparatus and/or system operation simulation package, such as a software electrical signal simulation package, a power usage and distribution simulation package, a radiation detection simulation package, an explosive device management and tracking package, and/or a combination of software and hardware used to simulate the operation of various potential embodiments.

It should also be understood that the apparatus and systems of various embodiments can be used in applications other than for transporting radioactive sources and explosives, and thus, various embodiments are not to be so limited. The illustrations of apparatus 100, 200 and systems 110, 210 are intended to provide a general understanding of the structure of various embodiments, and they are not intended to serve as a complete description of all the elements and features of apparatus and systems that might make use of the structures described herein. Applications that may include the novel apparatus and systems of various embodiments may be included as sub-components within a variety of electronic and mechanical systems, such as land/sea/air vehicles, oil well platforms, cargo containers, and others. Further embodiments include a number of methods.

Figure 3:
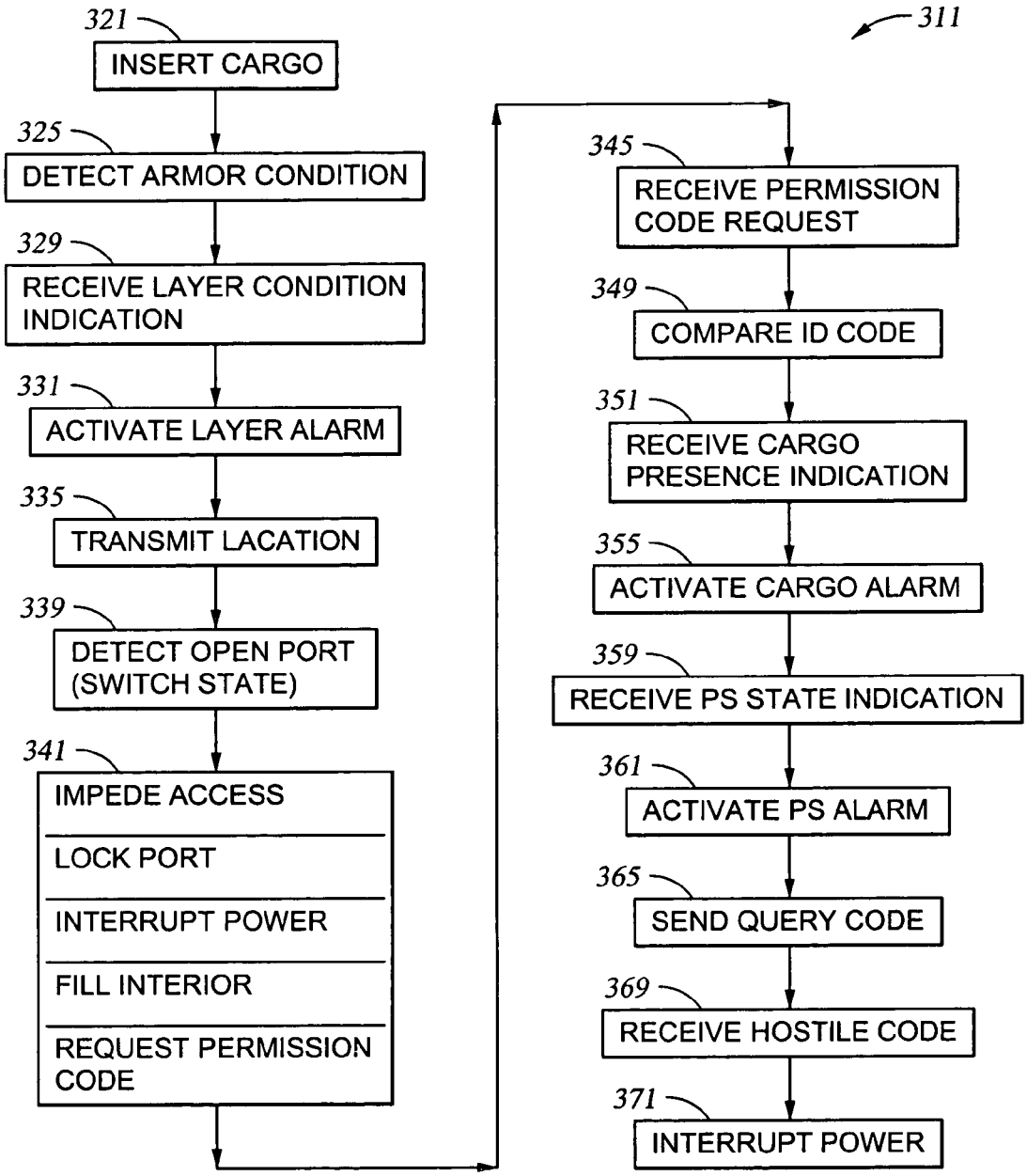
FIG. 3 is a flow diagram illustrating several methods according to various embodiments of the invention.

For example, FIG. 3 is a flow diagram illustrating several methods 311 according to various embodiments of the invention. Thus, it can be seen that a method 311 may (optionally) begin at block 321 with inserting cargo, such as a radiation source or explosive devices, into the interior portion of a container. Such a container may include an apparatus and/or system, similar to or identical to the apparatus 100 and systems 110 shown in FIG. 1 and described above.

The method 311 may include detecting a condition of one of the container layers at block 325. For example, the layers may include a first layer of armor substantially surrounding a heat absorbing layer and a second layer of armor including the interior portion. The method 311 may continue with receiving an indication of the condition of one or more of the layers at block 329, and activating an alarm responsive to the indication at block 331. The method 311 may also include transmitting a location associated with the interior portion and/or cargo responsive to the indication at block 335.

Many conditions may be sensed and indicated. For example, the indicated condition may be a temperature, a level of shock, and/or a vibration that exceeds a preselected level with respect to the container layers. The length of time over which the condition is indicated may also be used to selectively activate an alarm and/or transmit a location. In some embodiments, the method 311 may include detecting an open condition of a lockable port providing access to the interior portion via the layers, such as the first and the second layers of armor, and/or detecting a state of a tamper-resistant switch coupled to the lockable port at block 339. If a container includes a controller, the controller may in turn be coupled to receive an indication of the condition of one or more of the layers of the container, as well as the other indications described herein.

The method 311 may include impeding access to the interior portion responsive to detecting the condition at block 341. For example, impeding access to the interior portion may comprise one or more of: (1) locking a lockable port providing access to the interior portion via the layers, such as the first and second layers of armor, (2) interrupting power to a lock included in the lockable port providing access to the interior portion, (3) substantially filling the interior portion with a cargo-immobilizing substance, and (4) requesting a permission code from a local control station and a remote control station, perhaps prior to permitting access to the interior portion via the lockable port and a two-stage permission mechanism. Thus, the method 311 may include receiving a request for a permission code to grant access to the interior portion at block 345, and comparing an identification code associated with the first layer of armor (and/or the cargo) to a plurality of identification codes included in a file comprising identification codes of missing containers and/or cargo before transmitting the permission code.

In some embodiments, the method 311 may include receiving an indication of a state of cargo presence in the interior portion at block 351. Such an indication may be a simple binary indication, such as CARGO PRESENT and CARGO NOT PRESENT. Thus, the method 311 may include activating an alarm responsive to the indication of the state of the cargo, such as a radiation source or explosives, being NOT PRESENT in the interior portion at block 355.

Many other indications may be presented, received, and used to provoke various responses. For example, the method 311 may include receiving an indication of a state of the power supply coupled to a controller or to an electric lock included in the lockable port at block 359. Such an indication may represent the presence of a low battery, or that the voltage of the power supply is below a specified value. An alarm responsive to the indication of the state of the power supply may be activated at block 361.

As noted previously, a local control station and/or a remote control station may operate to send a query code to the container, perhaps including a controller, for the purpose of ascertaining the condition of the container, its layers, and/or the transported cargo at block 365. If no response (e.g., an assurance code) is received, or a hostile code is received at block 369, a power-interrupting device coupled to a lock providing access to the interior portion of the container may be activated (so as to lock the lockable port and to disable access to the interior portion). The hostile code received at block 369 may be received in response to the query code asserted at block 365, or independent of such a query code transmission.

It should be noted that the methods described herein do not have to be executed in the order described, or in any particular order. Moreover, various activities described with respect to the methods identified herein can be executed in repetitive, serial, or parallel fashion. Information, including parameters, commands, operands, and other data, can be sent and received in the form of one or more carrier waves.

Upon reading and comprehending the content of this disclosure, one of ordinary skill in the art will understand the manner in which a software program can be launched from a computer-readable medium in a computer-based system to execute the functions defined in the software program, such as the activities included in the methods outlined above. One of ordinary skill in the art will further understand the various programming languages that may be employed to create one or more software programs designed to implement and perform the methods disclosed herein. The programs may be structured in an object-orientated format using an object-oriented language such as Java or C++. Alternatively, the programs can be structured in a procedure-orientated format using a procedural language, such as assembly or C. The software components may communicate using any of a number of mechanisms well known to those skilled in the art, such as application program interfaces or interprocess communication techniques, including remote procedure calls. The teachings of various embodiments are not limited to any particular programming language or environment.

Additional capability to manage the transport of material, including radioactive sources and explosives may result from implementing the apparatus, systems, and methods disclosed herein. Some embodiments may also operate to assist in regulating access to such material in a wide range of industrial situations, including those present in the oil well drilling environment.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

a first layer of armor;

a heat absorbing layer substantially surrounded by the first layer of armor;

a second layer of armor having an interior portion substantially surrounded by the heat absorbing layer;

a lockable port to provide access to the interior portion via the first and second layers of armor, wherein the lockable port includes a lock activated based on an indication of a condition associated with at least one of the first layer of armor and the second layer of armor; and a communications interface coupled to the lockable port.

2. The apparatus of claim 1, wherein the interior portion is to substantially contain radiation from a radiating source.

3. The apparatus of claim 1, further comprising:

a vibration sensor to indicate a level of vibration experienced by the first layer of armor.

4. The apparatus of claim 1, further comprising:

a temperature sensor to sense a temperature of the first layer of armor.

5. The apparatus of claim 1, further comprising:

a shock sensor to sense a level of shock experienced by the first layer of armor.

6. The apparatus of claim 1, further comprising:

a heat-activated, human-toxic material substantially surrounded by the first layer of armor.

7. The apparatus of claim 6, wherein the heat-activated, human toxic material comprises a phenolic compound.

8. The apparatus of claim 1, wherein the heat-absorbing layer comprises silica.

9. The apparatus of claim 1, wherein the first layer of armor comprises a material selected from at least one of a metal and a ceramic.

10. The apparatus of claim 1, wherein the second layer of armor comprises a material selected from at least one of an aramid fiber, a shear-thickening fluid, and a polyethylene.

11. The apparatus of claim 1, further including:

a tamper-resistant switch responsive to an open condition of the lockable port.

12. The apparatus of claim 1, further including:

a cargo-immobilizing mechanism to receive an indication associated with the first layer of armor exceeding a selected level.

13. The apparatus of claim 1, further including:

a geolocation device to provide location coordinates associated with the interior portion.

14. The apparatus of claim 1, further including:

a radiation detection device coupled to the lockable port.

15. The apparatus of claim 1, further including:

a communications transceiver coupled to the lockable port.

16. The apparatus of claim 1, further including:

a power-interrupting device coupled to a power supply of an electric lock included in the lockable port.

17. The apparatus of claim 16, further including:

a two-stage permission mechanism coupled to the power-interrupting device.

18. The apparatus of claim 17, wherein the two-stage permission mechanism is to activate the power-interrupting device responsive to receiving a hostile code from at least one of a local control station and a remote control station.

19. The apparatus of claim 17, wherein the two-stage permission mechanism is to deactivate the power-interrupting device responsive to receiving a permission code from a remote control station.

20. A system, comprising:

a first layer of armor;

a heat absorbing layer substantially surrounded by the first layer of armor;

a second layer of armor having an interior portion substantially surrounded by the heat absorbing layer;

a lockable port to provide access to the interior portion via the first and second layers of armor, the lockable port comprising a lock; and an electronic controller coupled to the lockable port, the controller to activate the lock based on an indication of a condition associated with at least one of the first layer of armor and the second layer of armor.

21. The system of claim 20, wherein the interior portion is to substantially contain radiation from a radiating source.

22. The system of claim 20, further including:

a sensor coupled to the controller to sense an indication of a condition of the first layer of armor.

23. The system of claim 22, wherein the sensor is selected from at least one of a vibration sensor, a temperature sensor, and a shock sensor.

24. The system of claim 20, further including:

a cargo-immobilizing mechanism, wherein the controller is to activate the cargo-immobilizing mechanism responsive to an indication of a condition of the first layer of armor exceeding a selected level.

25. The system of claim 20, further including:

a communications interface coupled to the controller.

26. The system of claim 20, further including:

a geolocation device coupled to the controller.

27. The system of claim 20, further including a radiation detection device coupled to the controller.

28. The system of claim 20, further comprising:

a heat-activated, human-toxic material substantially surrounded by the first layer of armor.

29. The system of claim 28, wherein the heat-activated, human toxic material comprises a phenolic compound.

30. The system of claim 20, wherein the heat absorbing layer comprises silica.

31. The system of claim 20, wherein the first layer of armor comprises a material selected from at least one of a metal and a ceramic.

32. The system of claim 20, wherein the second layer of armor comprises a material selected from at least one of an aramid fiber, a shear-thickening fluid, and a polyethylene.

33. The system of claim 20, further including:

a communications transceiver coupled to the controller.

34. The system of claim 20, further including:

a power-interrupting device coupled to the controller and a power supply of an electric lock included in the lockable port.

35. The system of claim 34, further including:

a two-stage permission mechanism coupled to the power-interrupting device.

36. The system of claim 35, wherein the two-stage permission mechanism is to activate the power-interrupting device responsive to receiving a hostile code from at least one of a local control station and a remote control station.

37. The system of claim 35, wherein the two-stage permission mechanism is to deactivate the power-interrupting device responsive to receiving a permission code from a remote control station.

38. The system of claim 20, further including:

a tamper-resistant switch coupled to the controller and to the lockable port.

39. An apparatus, comprising:

a first layer of armor;

a heat absorbing layer substantially surrounded by the first layer of armor;

a second layer of armor having an interior portion substantially surrounded by the heat absorbing layer;

a lockable port to provide access to the interior portion via the first and second layers of armor, wherein the lockable port includes a lock activated based on an indication of a condition associated with at least one of the first layer of armor and the second layer of armor; and a radiation detection device coupled to the lockable port.

40. The apparatus of claim 39, wherein the interior portion is to substantially contain radiation from a radiating source.

41. The apparatus of claim 39, further comprising:

a vibration sensor to indicate a level of vibration experienced by the first layer of armor.

42. The apparatus of claim 39, further comprising:

a temperature sensor to sense a temperature of the first layer of armor.

43. The apparatus of claim 39, further comprising:

a shock sensor to sense a level of shock experienced by the first layer of armor.

44. The apparatus of claim 39, further comprising:

a heat-activated, human-toxic material substantially surrounded by the first layer of armor.

45. The apparatus of claim 44, wherein the heat-activated, human toxic material comprises a phenolic compound.

46. The apparatus of claim 39, wherein the heat-absorbing layer comprises silica.

47. The apparatus of claim 39, wherein the first layer of armor comprises a material selected from at least one of a metal and a ceramic.

48. The apparatus of claim 39, wherein the second layer of armor comprises a material selected from at least one of an aramid fiber, a shear-thickening fluid, and a polyethylene.

49. The apparatus of claim 39, further including:

a tamper-resistant switch responsive to an open condition of the lockable port.

50. The apparatus of claim 39, further including:

a cargo-immobilizing mechanism to receive an indication associated with the first layer of armor exceeding a selected level.

51. The apparatus of claim 39, further including:

a geolocation device to provide location coordinates associated with the interior portion.

52. The apparatus of claim 39, further including:

a communications transceiver coupled to the lockable port.

53. The apparatus of claim 39, further including:

a power-interrupting device coupled to a power supply of an electric lock included in the lockable port.

54. The apparatus of claim 53, further including:

a two-stage permission mechanism coupled to the power-interrupting device.

55. The apparatus of claim 54, wherein the two-stage permission mechanism is to activate the power-interrupting device responsive to receiving a hostile code from at least one of a local control station and a remote control station.

56. The apparatus of claim 54, wherein the two-stage permission mechanism is to deactivate the power-interrupting device responsive to receiving a permission code from a remote control station.

* * * * *